United States Patent [19]

O'Brien

[11] 4,081,182

[45] Mar. 28, 1978

[54] RIDABLE RECREATION DEVICE

[76] Inventor: Kevin P. O'Brien, 3541 SW. Vermont, Portland, Oreg. 97219

[21] Appl. No.: 715,393

[22] Filed: Aug. 18, 1976

[51] Int. Cl.[2] ..... A63B 5/00

[52] U.S. Cl. ..... 272/114

[58] Field of Search ..... 272/114, 115, 70, 101, 272/109, 130, 144, 145, 97, 33 A, 1 B, 1 R, 1 E, 1 D, 52, 52.5, 65, 146; 9/310 F, 310 G, 310 R, 310 A, 310 B, 310 C, 310 D, 310 E, 310 H, 310 J, 310 AA; 46/87, 88, 90

[56] References Cited

U.S. PATENT DOCUMENTS

| | | | |
|---|---|---|---|
| D. 169,631 | 5/1953 | Norman et al. | 46/87 X |
| 2,173,388 | 9/1939 | Barcroft | 272/71 X |
| 2,665,519 | 1/1954 | Burkes | 272/1 B |
| 2,688,207 | 9/1954 | Hurt | 272/1 B X |
| 2,761,155 | 9/1956 | Headley | 272/1 B |
| 3,048,395 | 8/1962 | Hobbs | 272/1 B |
| 3,098,317 | 7/1963 | Guzman | 272/52 X |
| 3,135,978 | 6/1964 | Grasmoen | 9/310 F X |
| 3,368,228 | 2/1968 | Heckathorn | 272/1 B X |
| 3,455,571 | 7/1969 | Dallera et al. | 9/310 F X |
| 3,557,398 | 1/1971 | Pierce | 9/310 C |

FOREIGN PATENT DOCUMENTS

| | | | |
|---|---|---|---|
| 7,005,221 | 10/1971 | Netherlands | 272/114 |
| 1,297,837 | 11/1972 | United Kingdom | 272/114 |

*Primary Examiner*—Richard C. Pinkham

*Assistant Examiner*—Arnold W. Kramer

*Attorney, Agent, or Firm*—Chernoff & Vilhauer

[57] ABSTRACT

A resilient object adapted to be ridden by a person sitting or standing thereon and exerting repeated jumping motions thereagainst. In one embodiment, the device comprises a resilient body member having an upper seat portion and a lower bottom portion, a handle member attached proximate its seat portion, and foot supports extending from either side of its lower portion. The device is ridden by a rider sitting on the seat portion with his legs astraddle the body member, grasping the handle member and exerting repeating jumping motions against the foot supports to bounce the device across the ground. In a second embodiment, the device comprises a horizontally oriented resilient body member having an overall width dimension substantially greater than its heighth dimension, and including a pair of foot supports attached to its upper surface for engaging the feet of a rider standing thereon. This latter device is ridden by a rider standing on the upper surface of the body member, with his feet engaged by the foot supports, and jumping up and down to bounce the device across the ground. In either embodiment, the body member may be filled with a resilient material or be substantially hollow and inflatable. A reinforcing layer of resilient material is provided over the lower surface of the body member to protect it from damage caused by repeated contact with the ground as the device is ridden.

7 Claims, 7 Drawing Figures

FIG. 1
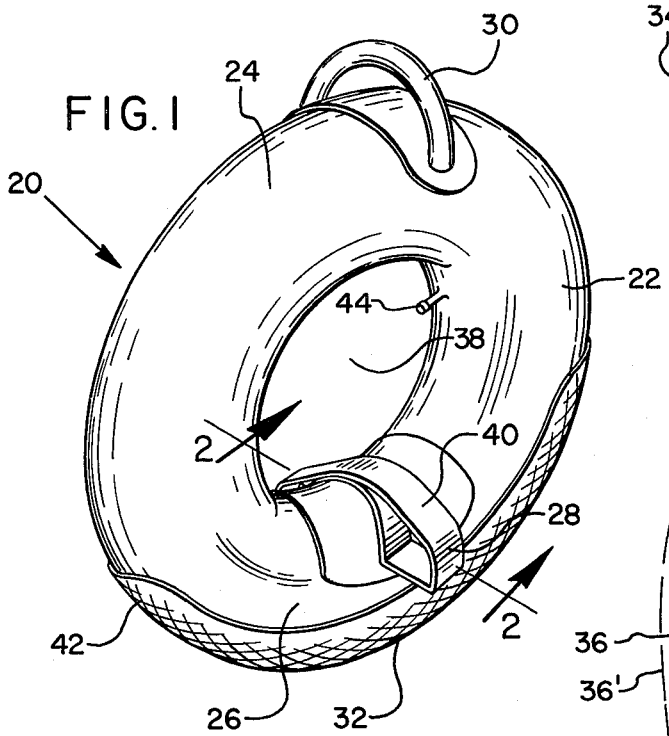
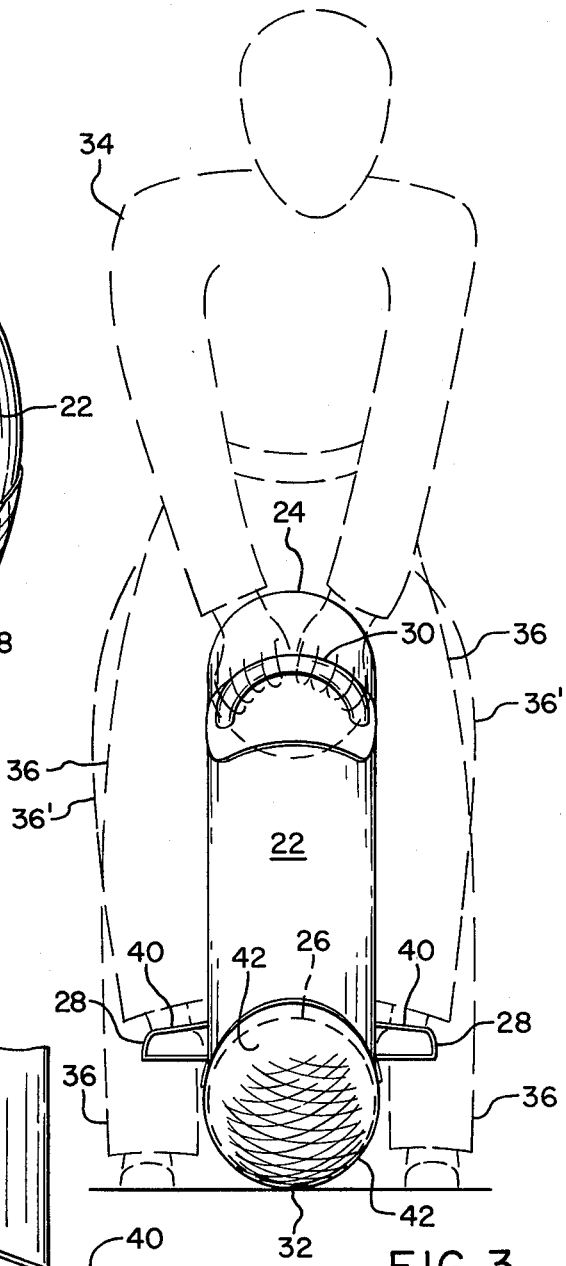
FIG. 3
FIG. 2
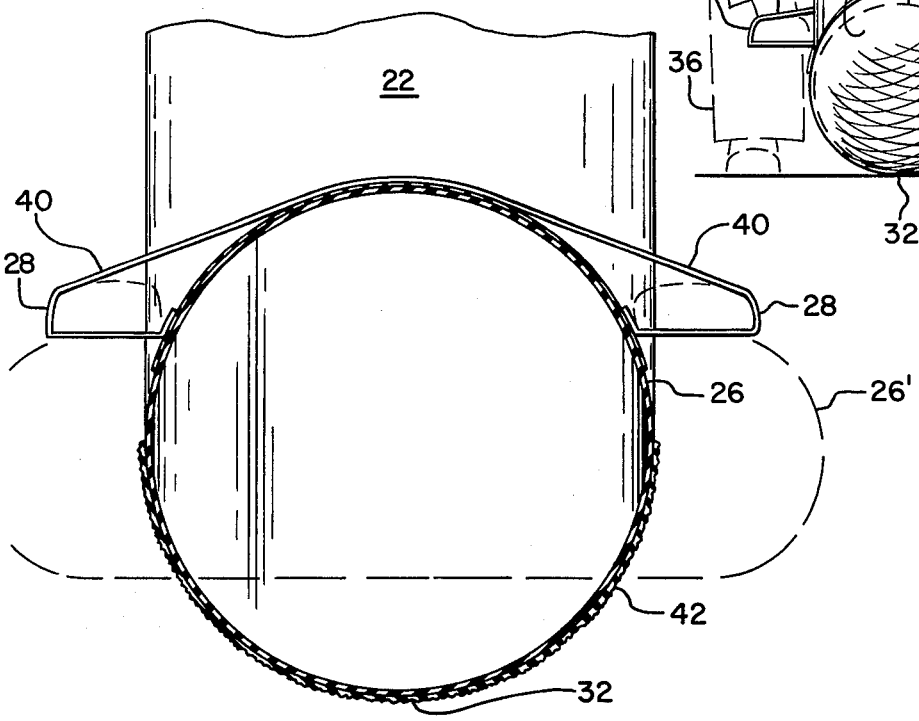

RIDABLE RECREATION DEVICE

BACKGROUND OF THE INVENTION

The present invention relates to a recreational device adapted to be ridden by a person sitting or standing thereon while causing the device to bounce across the ground. Examples of such devices include those disclosed by Van der Cleyen et al U.S. Pat. No. 3,716,229, Brown U.S. Pat. No. 3,627,314, Bennett et al U.S. Pat. No. 3,520,534, and Johns U.S. Pat. No. 2,884,247. Both the Bennett and Johns patents disclose devices that may be ridden by a person seated thereon, while the Van der Cleyen and Brown patents disclose devices that are ridable by a person in a standing position.

A principal characteristic of known prior art devices that may be ridden by a seated person is that there are no means provided for supporting the rider's feet and therefore, to operate the device, the rider must exert a jumping or bouncing motion with his feet repeatedly being brought into contact with the ground. Consequently, the sensation provided by such devices is more of an assisted jump than a bouncing ride. On the other hand, those known prior art devices that may be ridden by a person in a standing position, while providing a more bouncing-type ride, are either unstable when at rest or require the rider to grasp a pole or other handle means in order to remain in position atop the device.

SUMMARY OF THE INVENTION

The present invention is directed to a recreational device that may be ridden by a person either sitting or standing thereon and exerting a repeated jumping motion thereagainst. More particularly, the ridable recreation device of the present invention comprises a resilient body member adapted in alternate embodiments to be ridden by a person sitting or standing thereon and exerting repeated jumping motions against foot supporting means associated therewith. The exertion of such repeated jumping motions causes the device to be propelled across the ground in a bouncing- or jumping-like manner without requiring that the rider's feet be brought into repeated contact with the ground.

In a first embodiment, the device of the present invention includes an upright resilient body member having an upper seat portion and a lower bottom portion, with the seat portion being spaced a sufficient distance above the bottom portion so that, when the device is resting on the ground, a rider may sit on the seat portion with his legs extended and astraddle the sides of the body member and with his feet also resting on the ground. Foot support members or other suitable means are mounted on either side of the body member proximate its bottom portion for supporting the feet of the seated rider when his legs are flexed slightly. (As used herein "flexed slightly" means flexed less than half the distance from fully extended to fully flexed.) Handle means are provided proximate the seat portion of the body member to facilitate grasping the device as it is being ridden.

The device is ridden by a rider sitting on the seat portion, grasping the handle member with his hands and exerting repeated jumping- or bouncing-type motions with his feet pressed against the foot support members. In this manner the device, and the seated rider, may be readily propelled across the ground without the feet of the rider coming in repeated contact with the ground.

The body member itself may be formed of or filled with a lightweight resilient material such as an elastomeric foam or it may be a resilient shell that is substantially hollow and inflatable. It may also assume any suitable shape having a seat portion spaced the required distance above a corresponding bottom portion. One such suitable shape for the body member is the toroid such as defined by an inner tube from a conventional motor vehicle pneumatic tire.

In a second embodiment, the device comprises a horizontally oriented resilient body member having an overall width dimension substantially greater than its heighth dimension and having foot support means attached directly to its resilient upper surface for receiving and retaining the feet of a person standing thereon. This second embodiment is ridden by a person standing directly on the body member, with his feet in contact with the resilient upper surface and engaged by the foot support means, and exerting a repeated jumping motion to bouncingly propel the device across the ground. The foot support means are configured so as to prevent the rider's feet from leaving the upper surface of the device as the device is being ridden. By requiring the overall width dimension of the body member to be substantially greater than its heighth dimension, a device is provided that is stable when at rest and upon which the standing rider can stand without need of a handle or other means for maintaining an upright position. By mounting the foot support means directly on the resilient upper surface of the body member in a manner permitting the rider's feet to remain in contact therewith while the device is being ridden, the rider's feet are protected from impact with the ground or other hard surfaces, thereby providing a softer ride than is possible with known prior art devices. This protection of the rider's feet is more important with the second embodiment of the device than with the first as the second embodiment does not employ a seat and therefore requires that the rider's entire weight be supported through his feet. As before, the body member may be formed of or filled with a suitable resilient material or it may be a resilient shell that is substantially hollow and inflatable. A suitable shape for the body member, also as before, is the toroid presented by the conventional vehicular inner tube.

It is, therefore, a principal objective of the present invention to provide a recreation device that may be ridden by a person sitting thereon and exerting a repeated jumping motion thereagainst without requiring the person's feet to be in contact with the ground.

It is a further principal objective of the present invention to provide a recreational device that may be ridden by a person standing thereon and exerting a repeated jumping motion thereagainst without requiring the person's feet to be in contact with the ground or other rigid surface.

It is a further objective of the present invention to provide a recreational device of the type described that presents a stable support for a person standing thereon yet may be ridden by such standing person without requiring that a portion of the device be grasped by the hands.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 1 is a perspective view of a first exemplary embodiment of the ridable recreation device of the present invention.

FIG. 2 is a detail sectional view of the lower portion of the device of FIG. 1 taken along line 2—2.

FIG. 3 is a front view of the device of FIG. 1 showing the position of a rider mounted thereon.

DETAILED DESCRIPTION OF THE INVENTION

Figure 4:
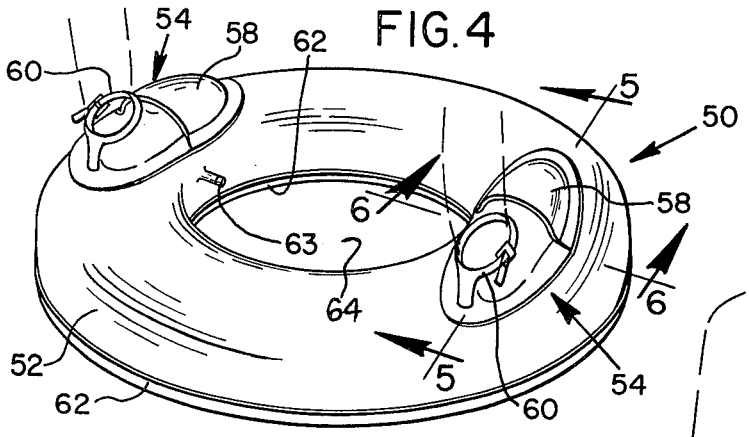
FIG. 4 is a perspective view of a second exemplary embodiment of the ridable device of the present invention.
Figure 5:
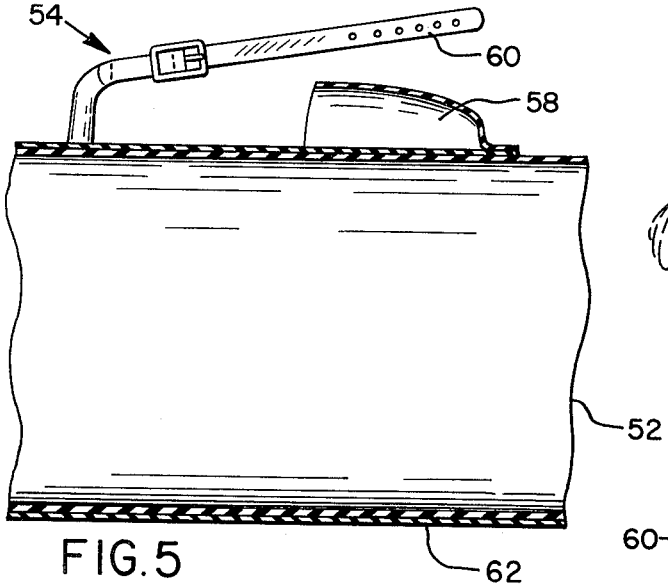
FIG. 5 is a detail sectional view of the device of FIG. 4 taken along line 5—5.
Figure 6:
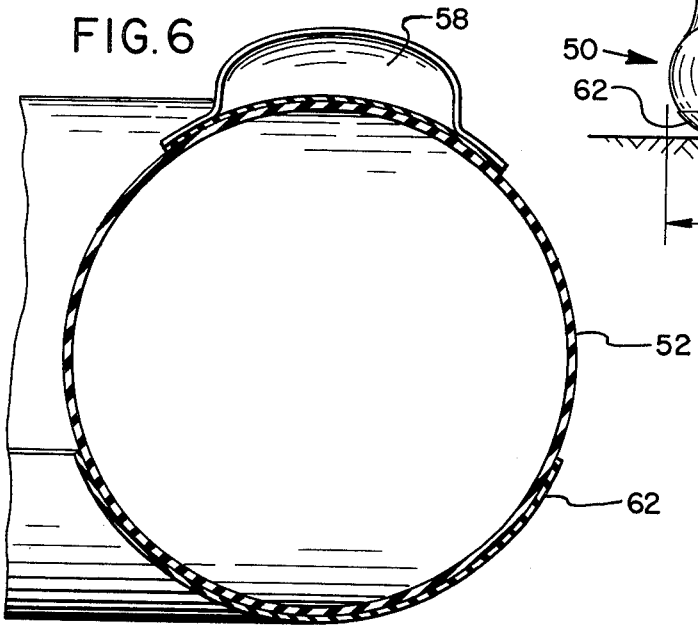
FIG. 6 is a detail sectional view of the device of FIG. 4 taken along line 6—6.

As shown in FIGS. 1–3, a first embodiment of the recreation device of the present invention, denoted generally as 20, comprises an upright inflatable body member 22, having an upper seat portion 24 and a lower bottom portion 26, foot support members 28 extending from either side of the body member proximate its bottom portion, and a handle member 30 attached to the body member proximate its seat portion. The seat portion 24 of the body member 22 is spaced a distance above the lower extremity 32 of the body member sufficient to permit a rider 34 to sit on the seat portion with his legs extended and astraddle the body member, as shown by the dashed lines 36 of FIG. 3, and with his feet substantially even with the lower extremity 32 of the body member. This spacing of the seat portion 24 a substantial distance above the lower portion 26 of the body member permits the rider's feet to be moved, by a slight flexing of the legs, as indicated by the dashed lines 36′ of FIG. 3, to the position of the foot support members 28 preparatory to riding the device as described more fully below.

The body member 22 is formed of any suitable resilient material and may be either hollow and inflatable, or filled with a similarly suitable resilient material such as an elastomeric foam. For a hollow and inflatable body member 22, a suitable valve means 44, shown in FIG. 1, is provided for permitting the introduction of a gas such as air into the interior of the body member. To lighten the device and increase its resilience, an aperture 38 may be formed through the center of the body member 22, as shown most clearly in FIG. 1, giving the device a substantially toroidal configuration. Other body member configurations may be used as well, the important criteria being the above-mentioned spacing of the body portion 22 above the bottom portion 26.

The foot support members 28 extending from either side of the bottom portion 26 of the body member 22 may be of any rigid or flexible material capable of supporting a substantial portion of a rider's weight. If a rigid material is used, as is preferred, the upper portion 40 of the foot support member would not be required; however, if a flexible material such as web belting or the like is employed, the upper portion 40 of the foot support member will serve to complete a loop on either side of the body member through which the feet may be inserted. Other suitable support member configurations may be employed without departing from the invention.

The handle member 30 attached to the body member 22 proximate the seat portion 24 may be of any suitable configuration facilitating a grasping of the device by the seated rider, and may be of either flexible or rigid material. A preferred shape for the handle member 30 is an inverted U attached at both ends to the body member 22. Lastly, the lower extremity 32 of the body member 22 is covered with a layer of resilient reinforcing material to protect the body member from damage while the device is being ridden.

To ride the embodiment of the recreational device of the present invention shown in FIGS. 1–3, a rider 34 first sits on the seat portion 24 of the body member 22 with his legs extended and astraddle the device as indicated by the dashed lines 36 in FIG. 3. The rider then grasps the handle member 30 with his hands, places his feet on the laterally projecting foot support members 28, as indicated by the dashed lines 36′, and bounces his weight up and down on the device by exerting a jumping motion with his feet pressed against the foot support members. In this manner, the device may be bouncingly propelled across the ground with the rider's weight divided between the foot support members 28 and the seat portion 24 of the body member 22, and without requiring the rider's feet to be brought into repeated pounding contact with the ground.

A second embodiment 50 of the recreational device of the present invention is shown in FIGS. 4–7 as comprising a horizontally oriented resilient body member 52 having a pair of foot support members 54 attached to its uppermost surface 56. The foot support members 54 include an enclosed forward toe portion 58 for receiving the forward portion of a rider's foot, and a strap 60 or other suitable means for engaging the rider's ankle. As before, the body member 52 may be hollow and inflatable or filled with a resilient foam material, and the lower portion of the body member may be covered with a layer of resilient reinforcing material 62 to protect the body member from damage as it is being ridden. A suitable valve means 63 is provided for filling the body member with air. For reasons of stability, the body member 52 is preferably of a thick disk-like configuration having a horizontally oriented width dimension substantially greater than its heighth dimension, as indicated by the arrows labeled W and H, respectively, in FIG. 7. This configuration is inherently stable when resting on one of its substantially flat sides, and is one that permits a rider to stand thereon without risk of losing his balance. As before, an aperture 64 may be formed through the center of the body member 52 to lighten the device and enhance its resilience.

Figure 7:
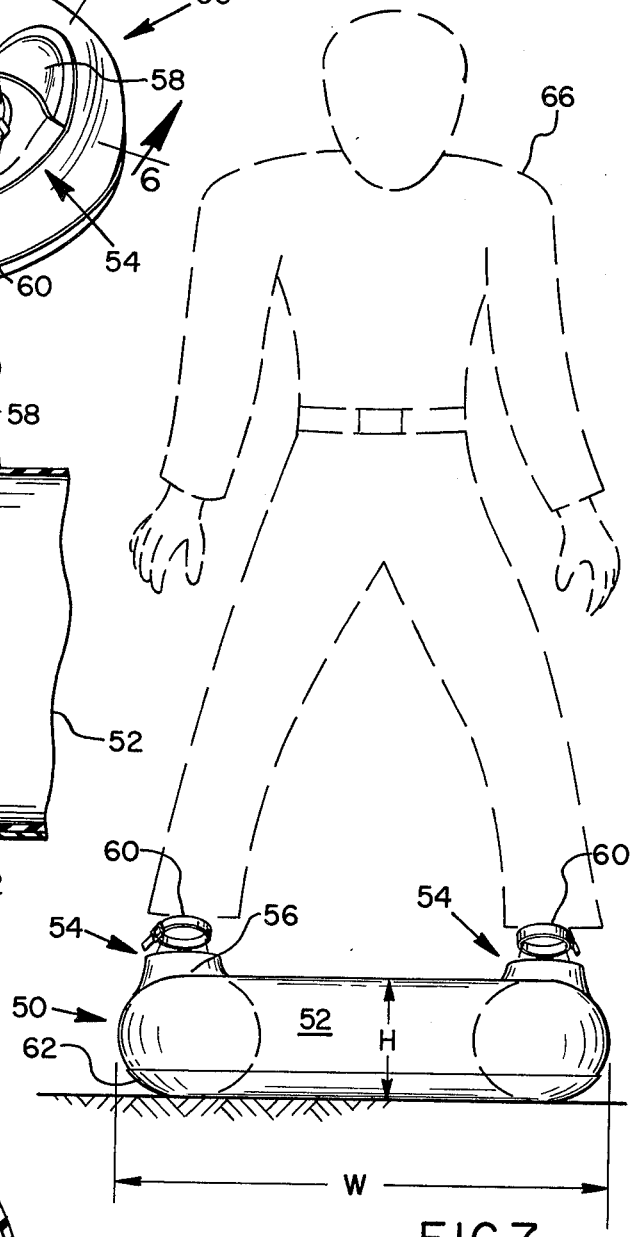
FIG. 7 is a front view of the device of FIG. 4 showing the position of a rider mounted thereon.

To ride the second embodiment 50 of the present invention, the device is placed on the ground in a horizontal position and a rider 66 stands atop the device, as shown in FIG. 7, with his feet resting on the upper surface 56 of the device and engaged by the foot support members 54. The rider then exerts a repeated jumping motion with his feet against the device to bouncingly propel both himself and the device across the ground. The toe portion 58 and the ankle strap 60 of each foot support member 54 ensures that the rider's feet remain securely coupled to the body member 52 as the device is being ridden. The stabilizing characteristics of the disk-like configuration of the body member 52 are most apparent in FIG. 7 where it is seen that the rider's weight is fully supported in a stable manner both when the device is stationary as well as when the device is being propelled across the ground.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A recreational device comprising:

(a) an upright body member of resilient material having an upper seat portion, a lower bottom portion and a pair of opposing ellipsoidal sides;

(b) an elongate handle means mounted on the outer surface of said body member proximate said upper seat portion and extending upwardly from said body member; and (c) a pair of foot support means each comprising a loop-shaped member having an elongate bottom portion and first and second upturned portions fastened at respective ends of said elongate bottom portion, said pair of foot support means being respectively mounted on said opposing ellipsoidal sides of said body member proximate said bottom portion of said body member such that said first upturned portions are in contiguous gripping contact with said opposing ellipsoidal sides, said second upturned portions are spaced outwardly in lateral relation to said opposing ellipsoidal sides and said elongate bottom portions are spaced downwardly from said upper seat portion, whereby said device and rider can be bouncingly propelled across solid terrain by a rider's sitting on said seat portion legs astraddle said body member and feet engaging said respective pair of foot support means with the legs in partially-flexed condition, grasping said body member by said handle means and exerting sudden compressive forces against said pair of foot support means by extending the legs in repeated jumping motions.

2. The device of claim 1 wherein said pair of opposing ellipsoidal sides are spaced apart by a predetermined distance less than that between said upper seat portion and said lower bottom portion.

3. The device of claim 1 wherein said body member has an upright, generally torroidal configuration.

4. The device of claim 3 wherein said pair of foot support means includes a reinforcing layer of resilient material fastened to said body member and interposed between said first upturned portions of said body member.

5. The device of claim 1 wherein said pair of foot support means includes an elongate upper portion respectively attached at each end thereof to said second upturned portions so as to close said loop-shaped members.

6. The device of claim 5 wherein said body member includes reinforcing means comprising a layer of resilient reinforcing material extending over and attached to the lower surface of said body member for both protecting said body member from wear caused by repeated contact with said solid supporting surface and assisting said body member to propel said device and rider across said solid supporting surface.

7. The device of claim 1 wherein said first upturned portions are fastened to each other and in contiguous gripping contact with said body member.

* * * * *